US007041368B2

(12) United States Patent
Cowan et al.

(10) Patent No.: US 7,041,368 B2
(45) Date of Patent: May 9, 2006

(54) HIGH SPEED SPINNING PROCEDURES FOR THE MANUFACTURE OF HIGH DENIER POLYPROPYLENE FIBERS AND YARNS

(75) Inventors: Martin E. Cowan, Moore, SC (US); Brian G. Morin, Greer, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 10/295,696

(22) Filed: Nov. 17, 2002

(65) Prior Publication Data

US 2004/0096653 A1 May 20, 2004

(51) Int. Cl.
*D02G 3/00* (2006.01)

(52) U.S. Cl. ..... 428/372; 428/394

(58) Field of Classification Search ..... 428/372, 428/394; 524/387
See application file for complete search history.

(56) References Cited

U.S. PATENT DOCUMENTS

| | | | | |
|---|---|---|---|---|
| 4,016,118 | A | 4/1977 | Hamada et al. | 260/17.4 SG |
| 4,116,626 | A | 9/1978 | Varner | 4/149 |
| 4,132,817 | A | 1/1979 | Tillotson | 427/244 |
| 4,171,395 | A | 10/1979 | Tollotson | 428/95 |
| 4,463,113 | A | 7/1984 | Nakahara et al. | 524/117 |
| 4,512,831 | A | 4/1985 | Tillotson | 156/78 |
| 4,522,857 | A | 6/1985 | Higgins | 428/95 |
| 4,560,734 | A | 12/1985 | Fujishita et al. | 526/142 |
| 5,049,605 | A | 9/1991 | Rekers | 524/108 |
| 5,136,520 | A | 8/1992 | Cox | 364/470 |
| 5,208,592 | A | 5/1993 | Johnson, Jr. | 341/63 |
| 5,231,126 | A | 7/1993 | Shi et al. | 524/296 |
| 5,342,868 | A | 8/1994 | Kimura et al. | 524/108 |
| 5,512,357 | A | 4/1996 | Shimura et al. | 428/283 |
| 5,540,968 | A | 7/1996 | Higgins | 428/95 |
| 5,545,276 | A | 8/1996 | Higgins | 156/79 |

(Continued)

FOREIGN PATENT DOCUMENTS

EP 0 611 271 10/1994

(Continued)

OTHER PUBLICATIONS

ASTM Test Method D 3417-99 "Standard Test Method for Enthalpies of Fusion and Crystallization of Polymers by Differential Scanning Calorimetry (DSC)" Spruiell et al. Journal of Applied Polymer Science, vol. 62, pp. 1965-1975 (1996).

(Continued)

*Primary Examiner*—N. Edwards
(74) *Attorney, Agent, or Firm*—Terry T. Moyer; John E. Vick, Jr.

(57) ABSTRACT

Improvements in permitting greater efficiency for high denier polypropylene fiber and yarn production are provided. Generally, spinning speeds are limited for polypropylene fibers and yarns as such materials tend to break easily upon exposure to excessively high tensions associated with low- to medium-spinning speeds. As spinning is required to properly draw such high denier fibers sufficiently for fiber and yarn production, such limitations effectively prevent widespread utilization of such fibers and yarns in various end-use applications. Thus, it has been surprisingly been determined that such high denier manufactured fibers and yarns can be produced with certain nucleating additives that permit tensile strength increases to the level required for high-speed spinning procedures to be followed. Additionally, low-shrink and/or better resiliency properties are also available with the addition of such nucleating compounds within the target high denier polypropylene resins.

3 Claims, 1 Drawing Sheet

U.S. PATENT DOCUMENTS

| | | | | |
|---|---|---|---|---|
| 5,753,736 | A | 5/1998 | Bhat | 524/287 |
| 5,798,167 | A | 8/1998 | Connor et al. | 428/171 |
| 5,811,045 | A | 9/1998 | Pike | 264/168 |
| 5,912,292 | A | 6/1999 | Sun | 524/301 |
| 5,945,215 | A | 8/1999 | Bersted et al. | 428/364 |
| 5,948,500 | A | 9/1999 | Higgins | 428/95 |
| 6,102,999 | A | 8/2000 | Cobb, III et al. | 106/243 |
| 6,110,588 | A | 8/2000 | Perez et al. | 428/359 |
| 6,127,440 | A | 10/2000 | Sanyasi | 521/74 |
| 6,127,470 | A | 10/2000 | Cobb, III et al. | 524/367 |
| 6,135,987 | A | 10/2000 | Tsai et al. | 604/365 |
| 6,162,887 | A | 12/2000 | Yamada et al. | 526/351 |
| 6,203,881 | B1 | 3/2001 | Higgins | 428/95 |
| 6,207,600 | B1 | 3/2001 | Nakajima et al. | 442/311 |
| 6,210,802 | B1 | 4/2001 | Risch et al. | 428/398 |
| 6,218,011 | B1 | 4/2001 | Raetzsch et al. | 428/394 |
| 6,231,976 | B1 | 5/2001 | Dean et al. | 428/373 |
| 6,238,615 | B1 | 5/2001 | Kobayashi et al. | 264/537 |
| 6,261,677 | B1 | 7/2001 | Tsai et al. | 428/221 |
| 6,270,608 | B1 | 8/2001 | Vair, Jr. et al. | 156/176 |
| 6,284,370 | B1 | 9/2001 | Fujimoto et al. | 428/221 |
| 6,300,415 | B1 | 10/2001 | Okayama et al. | 525/191 |
| 6,358,450 | B1 | 3/2002 | Sun | 264/178 |
| 6,420,024 | B1 | 7/2002 | Perez et al. | 428/359 |
| 6,468,623 | B1 | 10/2002 | Higgins | 428/95 |
| 6,534,574 | B1 | 3/2003 | Zhao et al. | 524/284 |
| 6,541,554 | B1 * | 4/2003 | Morin et al. | 524/387 |
| 6,559,211 | B1 | 5/2003 | Zhao et al. | 524/285 |
| 6,559,216 | B1 | 5/2003 | Zhao et al. | 524/336 |
| 6,656,404 | B1 | 12/2003 | Morin | 264/210.5 |
| 2001/0040320 | A1 | 11/2001 | Kobayashi et al. | 264/537 |
| 2001/0048179 | A1 | 12/2001 | Stewart et al. | 264/211 |
| 2002/0002241 | A1 | 1/2002 | Raetzsch et al. | 123/556 |

FOREIGN PATENT DOCUMENTS

| | | |
|---|---|---|
| EP | 0 806 237 | 7/1997 |
| JP | 11061554 A | 3/1999 |
| JP | 11140719 | 5/1999 |
| JP | P2002-302825 | 4/2001 |
| WO | 02/46502 | 6/2002 |

OTHER PUBLICATIONS

Strobl, G., The Physics of Polymers; Springer: Berlin 1997, pp. 408-414.

Patent abstracts of Japan; publication No. 11-061554; date of publication of application May 3, 1999; Highly heat-resistant polypropylene fiber; English translation.

Patent abstracts of Japan; publication No. 11-181619; date of publication of application Jun. 7, 1999; Highly heat-resistant polypropylene fiber and fiber-reinforced cement molded product using the same; English translation.

Patent abstracts of Japan; publication No. 2001-081628; date of publication Mar. 27, 2001; Flat yarn for base cloth of needle-punched carpet; English translation.

Patent abstracts of Japan; publication No. 2002-302825; date of publication Oct. 18, 2002; Highly-resistant polypropylene fibers; English translation.

Article; Journal of applied polymer science, vol. 62, 1965-1975 (1996) John Wiley & Sons, Inc.; Spruiell et al.

Article; The effects of pigments on the development of structure and properties of polypropylene filaments; Antec '91; Lin et al.

Article; The role of crystallization kinetics in the development of the structure and properties of polypropylene filaments; © 1993 John Wiley & Sons, Inc.; CCC 0021-8995/93/040623-9.

Article; Study on the formation of b-crystalline from isotactic polypropylene fiber; fiber and films, Intern. Polymer Processing VI, 1991; Chen et al.

Article; Heterogeneous Nucleation of Polypropylene and Polypropylene Fibers; Marcincin et al.; 1994.

* cited by examiner

HIGH SPEED SPINNING PROCEDURES FOR THE MANUFACTURE OF HIGH DENIER POLYPROPYLENE FIBERS AND YARNS

FIELD OF THE INVENTION

This invention relates to improvements in permitting greater efficiency for high denier polypropylene fiber and yarn production. Generally, spinning speeds are limited for polypropylene fibers and yarns as such materials tend to break easily upon exposure to excessively high tensions associated with low- to medium-spinning speeds. As spinning is required to properly draw such high denier fibers sufficiently for fiber and yarn production, such limitations effectively prevent widespread utilization of such fibers and yarns in various end-use applications. Thus, it has been surprisingly been determined that such high denier manufactured fibers and yarns can be produced with certain nucleating additives that permit tensile strength increases to the level required for high-speed spinning procedures to be followed. Additionally, low-shrink and/or better resiliency properties are also available with the addition of such nucleating compounds within the target high denier polypropylene resins.

DISCUSSION OF THE PRIOR ART

There has been a continued desire to utilize high denier polypropylene fibers in various different products, ranging from apparel to carpet backings (as well as carpet pile fabrics) to reinforcement fabrics, and so on. Polypropylene fibers exhibit excellent strength characteristics, highly desirable hand and feel, and do not easily degrade or erode when exposed to certain "destructive" chemicals. However, even with such impressive and beneficial properties and an abundance of polypropylene, which is relatively inexpensive to manufacture and readily available as a petroleum refinery byproduct, such fibers are not widely utilized in products that are exposed to relatively high temperatures during use, cleaning, and the like. This is due to the high and generally non-uniform heat- and moisture-shrink characteristics exhibited by typical polypropylene fibers, resiliency problems (such as a lack of effective crush-resistance of such yarns when present as face fibers for carpet), and, most importantly, the lack of reliable high-speed spinning manufacturing procedures available with polypropylene fibers and/or yarns in general. Although polyesters (such as polyethylene terephthalate, or PET) and polyamides (such as nylons) are generally more expensive to manufacture, such fibers do not exhibit the same unacceptable high shrinkage, undesirable resiliency, and manufacturing efficiency problems as polypropylenes. Thus, it is imperative to provide remedies to such issues to permit utilization of such lower cost polymer materials in greater varieties of end-uses. Such a need has heretofore gone unattained.

Such issues are quite prominent. For example, such polypropylene fibers are not heat stable and when exposed to standard temperatures (such as 150° C. and 130° C. temperatures), the shrinkage range from about 5% (in boiling water) to about 7–8% (for hot air exposure) to 12–13% (for higher temperature hot air). These extremely high and varied shrink rates thus render the utilization and processability of highly desirable polypropylene fibers very low, particularly for end-uses that require heat stability (such as apparel, carpet pile, carpet backings, molded pieces, and the like). Resiliency properties for PET and nylon are highly acceptable as compared with standard polypropylene types as well. Likewise, as note above, high speed spinning for quicker fiber ad/or yarn manufacturing (e.g., greater than 1000 m/min speeds) are basically unavailable for easily breakable polypropylene materials. Thus, there is room to improve in terms of manufacturing efficiencies for such polymer materials. Unfortunately, to date, there have been no simple or effective solutions to such problems.

DESCRIPTION OF THE INVENTION

It is thus an object of the invention to provide improved manufacturing efficiencies for polypropylene fiber and/or yarn production by permitting highly reliable high speed spinning processed to be followed with appreciable fiber breakage concerns. A further object of the invention is to provide a class of additives that, in a range of concentrations, will permit such efficiency improvements in high denier polypropylene fibers. A further object of the invention is to provide a specific method for the production of nucleator-containing polypropylene fibers exhibiting low shrink and/or better resiliency properties than for standard polypropylene fibers and/or yarns. Additionally, another object of this invention is to provide a polypropylene fiber and/or yarn that can withstand such necessary and desirable high speed spinning procedures.

Accordingly, this invention encompasses a method of producing polypropylene fibers exhibiting deniers per filament in excess of 5, preferably at least 12, comprising the sequential steps of a) providing a polypropylene composition in pellet or liquid form comprising at least 100 ppm by weight of a nucleator compound; b) melting and mixing said polypropylene composition of step "a" to form a substantially homogeneous molten plastic formulation; c) extruding said plastic formulation to form a fiber structure; and d) drawing said extruded fiber (optionally while exposing said fiber to a temperature of at most 105° C.) at a minimum speed of 1000 m/min. The same basic method is within this invention for yarns of at least 1000 denier per yarn with a spinning speed of at least 2000 m/min. Preferably, step "b" will be performed at a temperature sufficient to effectuate the melting of all polymer constituent (e.g., polypropylene), and possibly the remaining compounds, including the nucleating agent, as well (melting of the nucleating agent is not a requirement since some nucleating agents do not melt upon exposure to such high temperatures). Thus, temperatures within the range of from about 175 to about 300° C., as an example (preferably from about 190 to about 275°, and most preferably from about 200 to about 250° C., are proper for this purpose. The extrusion step ("c") should be performed while exposing the polypropylene formulation to a temperature of from about 185 to about 300° C., preferably from about 195 to about 275° C., and most preferably from about 200 to about 250° C., basically sufficient to perform the extrusion of a liquefied polymer without permitting breaking of any of the fibers themselves during such an extrusion procedure. The drawing step may be performed at a temperature which is cooler than normal for a standard polypropylene (or other polymer) fiber drawing process. Thus, if a cold-drawing step is followed, such a temperature should be below about 105° C., more preferably below about 100° C., and most preferably below about 90° C. Of course, higher temperatures may be used if no such cold drawing step is followed. The final heat-setting temperature is necessary to "lock" the polypropylene crystalline structure in place after extruding and drawing. Such a heat-setting step generally lasts for a portion of a second, up to potentially a couple of minutes (i.e., from about $1/10^{th}$ of a second, preferably about ½ of a second, up to about 3 minutes, preferably greater than ½ of a second). The heat-setting temperature must be greater than the drawing temperature and must be at least 110° C., more preferably at least about 115°, and most preferably at least about 125° C. The term "spinning" is intended to encompass any number of procedures which basically involve placing an extensional force on fibers in order to elongate the polymer therein. Such a procedure may be accomplished with any number of apparatus, including, without limitation, godet rolls, nip rolls, steam cans, hot or cold gaseous jets (air or steam), and other like mechanical means.

Such fibers (or yarns comprising such fibers) require the presence of certain compounds that quickly and effectively provide rigidity and/or tensile strength to the target polypropylene fiber to a level heretofore unavailable, particularly in terms of permitting high-speed spinning for greater efficiency in fiber and/or yarn manufacturing. Generally, these compounds include any structure that nucleates polymer crystals within the target polypropylene after exposure to sufficient heat to melt the initial pelletized polymer and upon allowing such a melt to cool. The compounds must nucleate polymer crystals at a higher temperature than the target polypropylene without the nucleating agent during cooling. In such a manner, the nucleator compounds provide nucleation sites for polypropylene crystal growth which, in turn, appear to provide thick lamellae within the fibers themselves which, apparently (without intending on being bound to any specific scientific theory) increase the tensile strengths of the target fibers to such a degree that the tensions associated with high-speed spinning can easily be withstood. The preferred nucleating compounds include dibenzylidene sorbitol based compounds, as well as less preferred compounds, such as sodium benzoate, certain sodium and lithium phosphate salts (such as sodium 2,2'-methylene-bis-(4,6-di-tert-butylphenyl)phosphate, otherwise known as NA-11 and NA-21).

All shrinkage values discussed as they pertain to the inventive fibers and methods of making thereof correspond to exposure times for each test (hot air and boiling water) of about 5 minutes. The heat-shrinkage at about 150° C. in hot air is, as noted above, at most 11% for the inventive fiber; preferably, this heat-shrinkage is at most 9%; more preferably at most 8%; and most preferably at most 7%. Also, the amount of nucleating agent present within the inventive fiber is at least 10 ppm; preferably this amount is at least 100 ppm; and most preferably is at least 1250 ppm. Any amount of such a nucleating agent should suffice to provide the desired shrinkage rates after heat-setting of the fiber itself; however, excessive amounts (e.g., above about 10,000 ppm and even as low as about 6,000 ppm) should be avoided, primarily due to costs, but also due to potential processing problems with greater amounts of additives present within the target fibers.

The target fibers and/or yarns may also be textured in any manner commonly followed for polypropylene materials. One example of this is false twist texturing, in which a twist is imparted to the fiber through the use of spindles, and while the fiber is in the twisted state it is heated and then cooled to impart into the individual filaments a memory of the twisted state. The yarn is then untwisted, but retains bulk due to the imparted memory. In another texturing embodiment, known as bulked continuous filament (BCF), the yarn is pushed with air jets into a stuffer box where it is crowded in a non-uniform state with other fibers and heated to retain the memory of this non-uniform state. The yarn is then cooled, but again retains bulk due to the imparted memory. Of course, other texturing methods, such as air texturing, gear texturing, etc., may be used. Polypropylene polymer containing nucleators retains the imparted memory of these texturing techniques better than polymer without nucleators because of the increased crystallization rate that the polypropylene undergoes when at elevated temperatures.

The term "polypropylene" is intended to encompass any polymeric composition comprising propylene monomers, either alone or in mixture or copolymer with other randomly selected and oriented polyolefins, dienes, or other monomers (such as ethylene, butylene, and the like). Such a term also encompasses any different configuration and arrangement of the constituent monomers (such as syndiotactic, isotactic, and the like). Thus, the term as applied to fibers is intended to encompass actual long strands, tapes, threads, and the like, of drawn polymer. The polypropylene may be of any standard melt flow (by testing); however, standard fiber grade polypropylene resins possess ranges of Melt Flow Indices between about 2 and 50. Contrary to standard plaques, containers, sheets, and the like (such as taught within U.S. Pat. No. 4,016,118 to Hamada et al., for example), fibers clearly differ in structure since they must exhibit a length that far exceeds its cross-sectional area (such, for example, its diameter for round fibers). Fibers are extruded and drawn; articles are blow-molded or injection molded, to name two alternative production methods. Also, the crystalline morphology of polypropylene within fibers is different than that of standard articles, plaques, sheets, and the like. For instance, the dpf of such polypropylene fibers is at most about 5000; whereas the dpf of these other articles is much greater. Polypropylene articles generally exhibit spherulitic crystals while fibers exhibit elongated, extended crystal structures. Thus, there is a great difference in structure between fibers and polypropylene articles such that any predictions made for spherulitic particles (crystals) of nucleated polypropylene do not provide any basis for determining the effectiveness of such nucleators as additives within polypropylene fibers.

The terms "nucleators", "nucleator compound(s)", "nucleating agent", and "nucleating agents" are intended to generally encompass, singularly or in combination, any additive to polypropylene that produces nucleation sites for polypropylene crystals from transition from its molten state to a solid, cooled structure. Hence, since the polypropylene composition (including nucleator compounds) must be molten to eventually extrude the fiber itself, the nucleator compound will provide such nucleation sites upon cooling of the polypropylene from its molten state. The only way in which such compounds provide the necessary nucleation sites is if such sites form prior to polypropylene recrystallization itself. Thus, any compound that exhibits such a beneficial effect and property is included within this definition. Such nucleator compounds more specifically include dibenzylidene sorbitol types, including, without limitation, dibenzylidene sorbitol (DBS), monomethyldibenzylidene sorbitol, such as 1,3:2,4-bis(p-methylbenzylidene) sorbitol (p-MDBS), dimethyl dibenzylidene sorbitol, such as 1,3:2,4-bis(3,4-dimethylbenzylidene) sorbitol (3,4-DMDBS); other compounds of this type include, again, without limitation, sodium benzoate, NA-11, NA-21, and the like. The concentration of such nucleating agents (in total) within the target polypropylene fiber is at least 100 ppm, preferably at least 1250 ppm. Thus, from about 100 to about 5000 ppm, preferably from about 500 ppm to about 4000 ppm, more preferably from about 1000 ppm to about 3500 ppm, still more preferably from about 1500 ppm to about 3000 ppm, even more preferably from about 2000 ppm to about 3000 ppm, and most preferably from about 2500 to about 3000 ppm.

Also, without being limited by any specific scientific theory, it appears that the required nucleators which perform the best are those which exhibit relatively high solubility within the propylene itself. Thus, compounds which are readily soluble, such as 1,3:2,4-bis(p-methylbenzylidene) sorbitol provides the lowest shrinkage rate for the desired polypropylene fibers. The DBS derivative compounds are considered the best shrink-reducing nucleators within this invention due to the low crystalline sizes produced by such compounds. Other nucleators, such as NA-11, NA-21, also impart acceptable characteristics to the target polypropylene fiber in terms of withstanding high speed spinning tensions; however, apparently due to poor dispersion of NA-11 in polypropylene and the large and varied crystal sizes of NA-11 within the fiber itself, the fiber strengths are noticeably lower than for the highly soluble, low crystal-size polypropylene produced by well-dispersed MDBS or, preferably, 3,4-DMDBS.

It has been determined that the nucleator compounds that exhibit good solubility in the target molten polypropylene resins (and thus are liquid in nature during that stage in the fiber-production process) provide more effective tensile strengths (for withstanding high speed spinning tension levels), resiliency properties, and low-shrink characteristics. Thus, substituted DBS compounds (including DBS, p-MDBS, and, preferably 3,4-DMDBS) appear to provide fewer manufacturing issues as well as lower shrink properties within the finished polypropylene fibers themselves. Although 3,4-DMDBS is preferred for such high denier fibers, any of the above-mentioned nucleators may be utilized within this invention. Mixtures of such nucleators may also be used during processing in order to provide such spinning efficiencies, resiliency measurements, and low-shrink properties as well as possible organoleptic improvements, facilitation of processing, or cost. In addition to those compounds noted above, sodium benzoate and NA-11 are well known as nucleating agents for standard polypropylene compositions (such as the aforementioned plaques, containers, films, sheets, and the like) and exhibit excellent recrystallization temperatures and very quick injection molding cycle times for those purposes. The dibenzylidene sorbitol types exhibit the same types of properties as well as excellent clarity within such standard polypropylene forms (plaques, sheets, etc.). For the purposes of this invention, it has been found that the dibenzylidene sorbitol types are preferred as nucleator compounds within the target polypropylene fibers.

The closest prior art references teach the addition of nucleator compounds to general polypropylene compositions (such as in U.S. Pat. No. 4,016,118, referenced above). However, some teachings include the utilization of certain DBS compounds within limited portions of fibers in a multicomponent polypropylene textile structure. For example, U.S. Pat. No. 5,798,167 to Connor et al. and U.S. Pat. No. 5,811,045 to Pike, both teach the addition of DBS compounds to polypropylene in fiber form; however, there are vital differences between those disclosures and the present invention. For example, both patents require the aforementioned multicomponent structures of fibers. Thus, even with DBS compounds in some polypropylene fiber components within each fiber type, the shrink rate for each is dominated by the other polypropylene fiber components which do not have the benefit of the nucleating agent. Also, there are no thick lamellae that can potentially provide the desired high tensile strengths formed within the disclosed polypropylene fibers. Of further importance is the fact that, for instance, Connor et al. require a nonwoven polypropylene fabric laminate containing a DBS additive situated around a polypropylene internal fabric layer which contained no nucleating agent additive. The internal layer, being polypropylene without the aid of a nucleating agent additive, dictates the shrink rate for this structure. Furthermore, the patentees do not discuss any high speed spinning possibilities for any high denier fibers at all, nor any drawing, heat setting, or texturing steps are included.

In addition, Spruiell, et al, *Journal of Applied Polymer Science*, Vol. 62, pp. 1965–75 (1996), reveal using a nucleating agent, MDBS, at 0.1%, to increase the nucleation rate during spinning. However, after crystallizing the fiber, Spruiell et al. do not expose the nucleated fiber to any heat, which is necessary to impart the very best shrinkage properties, therefore the shrinkage of their fibers was similar to conventional polypropylene fibers without a nucleating agent additive. Furthermore, no mention of tensile strength increases are discussed at all, not to mention at levels that are necessary to withstand high speed spinning tensions to prevent breakage of such fibers during processing thereby.

Furthermore, such fibers may also be colored to provide other aesthetic features for the end user. Thus, the fibers may also comprise coloring agents, such as, for example, pigments, with fixing agents for lightfastness purposes. For this reason, it is desirable to utilize nucleating agents that do not impart visible color or colors to the target fibers. Other additives may also be present, including antistatic agents, brightening compounds, clarifying agents, antioxidants, antimicrobials (preferably silver-based ion-exchange compounds, such as ALPHASAN® antimicrobials available from Milliken & Company), UV stabilizers, fillers, and the like. Furthermore, any fabrics made from such inventive fibers may be, without limitation, woven, knit, non-woven, in-laid scrim, any combination thereof, and the like. Additionally, such fabrics may include fibers other than the inventive polypropylene fibers, including, without limitation, natural fibers, such as cotton, wool, abaca, hemp, ramie, and the like; synthetic fibers, such as polyesters, polyamides, polyaramids, other polyolefins (including non-low-shrink polypropylene), polylactic acids, and the like; inorganic fibers such as glass, boron-containing fibers, and the like; and any blends thereof.

BRIEF DESCRIPTION OF THE DRAWINGS

The accompanying drawings, which are incorporated in and constitute a part of this specification, illustrate a potentially preferred embodiment of producing the inventive low-shrink polypropylene fibers and together with the description serve to explain the principles of the invention wherein.

DETAILED DESCRIPTION OF THE DRAWING AND OF THE PREFERRED EMBODIMENT

Figure 1:
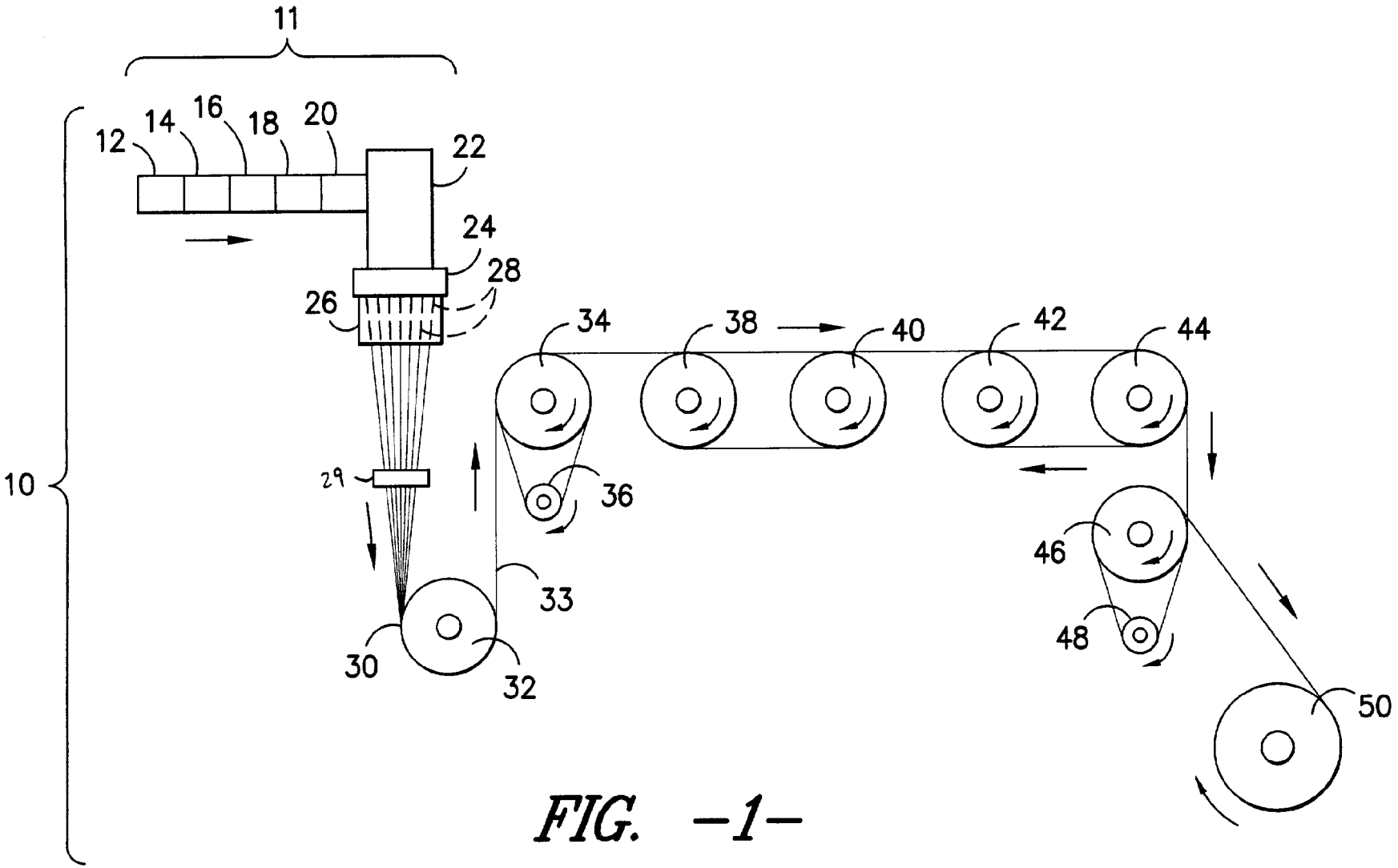
FIG. 1 is a schematic of the potentially preferred method of producing high denier polypropylene fibers through high speed spinning machinery.

FIG. 1 depicts the non-limiting preferred procedure followed in producing the inventive high denier polypropylene fibers. The entire fiber production assembly 10 comprises an extruder 11 including a metering pump (not illustrated) for introduction of specific amounts of polymer into the extruder 11 (to control the denier of the ultimate target manufactured fiber and/or yarn) which also comprises five different zones 12, 14, 16, 18, 20 through which the polymer (not illustrated) passes at different, increasing temperatures. The molten polymer is mixed with the nucleator compound (also molten) within a mixer zone 22. Basically, the polymer (not illustrated) is introduced within the fiber production assembly 10, in particular within the extruder 11. The temperatures, as noted above, of the individual extruder zones 12, 14, 16, 18, 20 and the mixing zone 22 are as follows: first extruder zone 12 at 205° C., second extruder zone 14 at 215° C., third extruder zone 16 at 225° C., fourth extruder zone 18 at 235° C., fifth extruder zone 20 at 240° C., and mixing zone 22 at 245° C. The molten polymer (not illustrated) then moves into a spinneret area 24 set at a temperature of 250° C. for strand extrusion. The fibrous strands 28 then pass through an air-blown treatment area 26 and then through a treatment area 29 whereupon a lubricant, such as water or an oil, is applied thereto the strands 28. The strands 28 are then collected into a bundle 30 via a take-up roll 32 to form a multifilament yarn 33 which then passes to a series of tensioning rolls 34, 36 prior to drawing. The yarn 33 then passes through a series of two different sets of draw rolls 38, 40, 42, 44 which increase the speed of the collected finished strands 33 as compared with the speed of the initially extruded strands 28. The finished strands 33 extend in length due to a greater pulling speed in excess of such an initial extrusion speed within the extruder 11. The strands 33 are then passed through a series of relax rolls 46, 48 and ultimately to a winder 50 for ultimate collection on a spool (not illustrated). The speed of the winder 50 ultimately dictates the speed and efficiency of the entire apparatus in terms of permitting high speed manufacturing and spinning (drawing) with minimal, if any, breakage of the target fibers during such a procedure. The draw rolls are heated to a very low level as follows: first draw rolls 38, 40 68° C. and the second set of draw rolls 42, 44 88° C., as compared with the remaining areas of high temperature exposure as well as comparative fiber drawing processes. The draw rolls 38, 40, 42, 44 individually and, potentially independently rotate at a speed of from about 1000 meters per minute to as high as about 5000 meters per minute. The second draw rolls 42, 44 generally rotate at a higher speed than the first in excess of about 800 meters per minute up to 1000 meters per minute over those of the first set.

Inventive Fiber and Yarn Production

The following non-limiting examples are indicative of the preferred embodiment of this invention:

Yarn Production

Yarn was made by compounding Basell PDC 1302 homopolymer propylene resin with a nucleator additive and a 1000 ppm of calcium stearate and running it through a 48 filament spinneret (for 48 multifilament yarn production). The base mixture was compounded at 2500 ppm in a twin screw extruder (at 220° C. in all zones) and made into pellets. The additive was selected from the group of three polypropylene clarifiers commercially available from Milliken & Company, Millad® 3940 (p-MDBS sorbitol) and Millad® 3988 (3,4-DMDBS).

The pellets were then fed into the extruder via a metering pump to control the amount for ultimate control of the denier of the fiber and/or yarn made therefrom on a Barmag fiber extrusion line as noted above in FIG. 1. Pellets with no nucleator additive were used to make control fibers. The winding and spinning speeds, as well as the breakage rates of the high denier fibers during such high-speed spinning and winding procedures were measured to determine if high denier polypropylene fibers and/or yarns could be properly produced (e.g., without appreciable breakage rates) thereby.

Spinning Speed and Breakage Rates

The basic experiment involved fiber manufacturing equipment further including a broken filament detector positioned in the yarn path just before the extruder. The maximum roll speeds for the two series of draw rolls were determined by increasing the speeds incrementally until a speed was reached above which the frequency of broken filaments increased dramatically with small changes in roll speed. The relax roll speeds and the winder speed were determined by adjusting the speeds to reach relax and winding tensions of ~20–30 grams of force. In this way, the maximum winding speed was determined for the production of quality yarns of maximum denier for the spinning speed range of 450–1450 m/min. The results are tabulated below:

TABLE 1

Fiber Samples

| Sample # | (Nucleator, ppm) | Winding Speed (m/min) | Maximum Yarn Denier (g/9000 m) | Maximum DPF (g/9000 m) |
|---|---|---|---|---|
| 1 | Control | 1965 | 1288 | 26.8 |
| 2 | Control | 3260 | 776 | 16.2 |
| 3 | Control | 4250 | 476 | 9.9 |
| 4 | p-MDBS (3000 ppm) | 1970 | 1388 | 28.9 |
| 5 | p-MDBS (3000 ppm) | 3310 | 948 | 19.8 |
| 6 | p-MDBS (3000 ppm) | 4430 | 663 | 13.8 |
| 7 | 3,4-DMDBS (2650 ppm) | 1980 | 1739 | 36.2 |
| 8 | 3,4-DMDBS (2650 ppm) | 3180 | 1083 | 22.6 |
| 9 | 3,4-DMDBS (2650 ppm) | 4080 | 869 | 18.1 |

Such results are based upon a breakage rate for the high-speed-spun fibers of at most 20 fluffs in the fiber measured per every five minutes of winding time (hereinafter referred to as "no appreciable breakage"). These results indicate that available denier levels for the are drastically lower than desired. Furthermore, the inventive fibers (4–9) provide significantly higher deniers at higher spinning speeds, thereby providing the ability to produce such higher denier fibers at much quicker speeds than previously available. As a result, the manufacturing efficiency of similarly low denier levels as the control fibers is increased, not to mention the ability to produce higher denier fibers more efficiently is now available. Both results are highly unexpected.

There are, of course, many alternative embodiments and modifications of the present invention which are intended to be included within the spirit and scope of the following claims.

What we claim is:

1. A polypropylene fiber comprising at least 100 ppm of a nucleator which does not impart visible color to said fiber; wherein said fiber is textured; wherein said polypropylene fiber exhibits a denier of at least 5 dpf; and wherein said fiber demonstrates tensile strength such that said fiber exhibits no appreciable breakage when exposed to spinning of at least about 1000 meters/minute.

2. The fiber of claim 1 wherein said fiber exhibits no appreciable breakage when exposed to spinning of at least about 2000 meters/minute.

3. The polypropylene fiber as recited in claim 1, wherein said nucleator is selected from the group consisting of DBS, MDBS, DMDBS, NA-11, and NA-21.

* * * * *